US009160075B2

(12) United States Patent
Tsai et al.

(10) Patent No.: US 9,160,075 B2
(45) Date of Patent: Oct. 13, 2015

(54) MULTI-BAND ANTENNA FOR PORTABLE COMMUNICATION DEVICE

(75) Inventors: Tiao-Hsing Tsai, Taoyuan (TW); Chi-Yin Fang, Taoyuan (TW); Chao-Hsu Wu, Taoyuan (TW); Tsung-Ming Kuo, Taoyuan (TW); Chun-Yuan Wang, Taoyuan (TW); Chien-Pin Chiu, Taoyuan (TW)

(73) Assignee: HTC CORPORATION, Taoyuan (TW)

( * ) Notice: Subject to any disclaimer, the term of this patent is extended or adjusted under 35 U.S.C. 154(b) by 571 days.

(21) Appl. No.: 13/304,722

(22) Filed: Nov. 28, 2011

(65) Prior Publication Data

US 2013/0135156 A1 May 30, 2013

(51) Int. Cl.

| | |
|---|---|
| ***H01Q 5/01*** | (2006.01) |
| ***H01Q 9/42*** | (2006.01) |
| ***H01Q 5/371*** | (2015.01) |
| *H01Q 1/24* | (2006.01) |
| *H01Q 1/48* | (2006.01) |
| *H01Q 13/18* | (2006.01) |

(52) U.S. Cl.

CPC ..... *H01Q 9/42* (2013.01); *H01Q 5/371* (2013.01); *H01Q 1/243* (2013.01); *H01Q 1/48* (2013.01); *H01Q 13/18* (2013.01)

(58) Field of Classification Search

CPC ..... H01Q 5/01
USPC ..... 343/702
See application file for complete search history.

(56) References Cited

U.S. PATENT DOCUMENTS 7,612,725 B2 11/2009 Hill et al.
7,629,940 B2 12/2009 Ke et al.
2003/0210193 A1* 11/2003 Rossman et al. ..... 343/725
2008/0007460 A1* 1/2008 Ke et al. ..... 343/700 MS
2008/0316115 A1 12/2008 Hill et al.

(Continued)

FOREIGN PATENT DOCUMENTS

CN 101682119 A 11/1995

OTHER PUBLICATIONS

SeongTae Jeong et al.: "Design and analysis of Multi-band antenna for mobile handset applications", Antennas and Propagation Society International Symposium, 2009. APSURSI' 09. IEEE, IEEE, Piscataway, NJ, USA, Jun. 1, 2009, pp. 1-4.
China Office Action dated Jul. 18, 2014.

(Continued)

*Primary Examiner* — Dameon E Levi
*Assistant Examiner* — Andrea Lindgren Baltzell
(74) *Attorney, Agent, or Firm* — McClure, Qualey & Rodack, LLP

(57) ABSTRACT

A multi-band antenna for a portable communication device is disclosed, in which the communication device includes a first housing, a second housing and a substrate. The multi-band antenna includes a feeding portion, a system ground plane, a metal ring, a resonant cavity, a first and a second radiating portion. The system ground plane is disposed on the substrate. The metal ring is connected to the first housing, and forms a space with the first housing to accommodate the substrate, in which the metal ring is electrically coupled to the system ground plane through a plurality of ground ends. The resonant cavity is formed between the system ground plane and the metal ring to generate a first resonant mode. The first and the second radiating portion are disposed on the second housing, for generating a second and a third resonant mode, respectively.

12 Claims, 5 Drawing Sheets

(56) References Cited

U.S. PATENT DOCUMENTS

| | | | | |
|---|---|---|---|---|
| 2009/0153407 | A1 | 6/2009 | Zhang et al. | |
| 2009/0256758 | A1 * | 10/2009 | Schlub et al. | 343/702 |

OTHER PUBLICATIONS

English translation of abstract of CN 101682119 A (published Nov. 2, 1995).

Taiwan Office Action dated Jan. 22, 2015.

* cited by examiner

MULTI-BAND ANTENNA FOR PORTABLE COMMUNICATION DEVICE

BACKGROUND

1. Field of Invention

The subject application relates to a multi-band antenna. More particularly, the subject application relates to a multi-band antenna for a portable communication device.

2. Description of Related Art

With various exterior designs of portable communication devices, portable communication devices having metal frames have become popular. Generally, in a design of an antenna for a portable communication device having a metal frame, the metal frame is cut into a plurality of discontinuous metal structures, so that the antenna can radiate radio frequency (RF) signals.

A conventional portable communication device utilizes a planar inverted-F antenna (PIFA) and a discontinuous metal frame to construct a multi-band antenna, such that requirements of lightness, thinness, short length, and small size of the portable communication device may be realized. However, constraints in the design of a multi-band antenna are encountered due to the spacing among an antenna main body, a system ground plane and the metal frame, increasing the difficulty of design. Moreover, this discontinuous metal structure may cause a frequency shift and radiation efficiency decline of resonant modes, thereby negatively affecting the communication quality of the portable communication device.

In view of foregoing, there is an urgent need in the related field to provide a solution.

SUMMARY

In one or more various aspects, the subject application is directed to a multi-band antenna for a portable communication device. The portable communication device includes a first housing, a second housing and a substrate. The multi-band antenna includes a feeding portion, a system ground plane, a metal ring, a resonant cavity, a first and a second radiating portion. The system ground plane is disposed on the substrate. The metal ring is connected to the first housing, and forms a space with the first housing to accommodate the substrate, in which the metal ring is electrically coupled to the system ground plane through a plurality of ground ends. The resonant cavity is formed between the system ground plane and the metal ring, and to generate a first resonant mode with the metal ring. The first and the second radiating portion are disposed on the second housing, for generating a second and a third resonant mode, respectively.

In accordance with an embodiment of the present disclosure, the foregoing multi-band antenna further includes a first conductive portion and a second conductive portion. The first conductive portion is disposed on the second housing, and the first radiating portion is electrically coupled to one side of the first conductive portion. The second radiating portion is electrically coupled to another side of the first conductive portion, and the first conductive portion is electrically coupled to the feeding portion when the first housing and the second housing are connected to each other. The second conductive portion is disposed on the second housing and electrically coupled to the first conductive portion, and the second conductive portion is electrically coupled to the metal ring when the first housing and the second housing are connected to each other. Furthermore, when the first housing and the second housing are connected to each other, a projection of the first conductive portion with respect to a normalized view of the substrate at least partially overlaps the resonant cavity.

In accordance with an embodiment of the present disclosure, a transverse dimension of the metal ring, a longitudinal dimension of the metal ring and a first gap width of the resonant cavity are used to control at least one of a resonant frequency of the first resonant mode, a bandwidth of the first resonant mode and a return loss of the first resonant mode.

In accordance with an embodiment of the present disclosure, the foregoing multi-band antenna further includes a first metal element disposed in the resonant cavity. An electrical length of the first metal element is used to adjust a current path and control a resonant frequency of the first resonant mode.

In accordance with an embodiment of the present disclosure, when an electrical length of the second radiating portion is longer than an electrical length of the first radiating portion, a resonant frequency of the third resonant mode is smaller than a resonant frequency of the second resonant mode.

In accordance with an embodiment of the present disclosure, when an electrical length of the second radiating portion is shorter than an electrical length of the first radiating portion, a resonant frequency of the third resonant mode is larger than a resonant frequency of the second resonant mode.

In accordance with an embodiment of the present disclosure, the foregoing multi-band antenna further comprises a second metal element and a third metal element, both of which are disposed on the second housing and electrically coupled to the first conductive portion. An electrical length of the second metal element is used to adjust an impedance matching of the first radiating portion, and an electrical length of the third metal element is used to adjust an impedance matching of the second radiating portion.

In accordance with an embodiment of the present disclosure, the feeding portion is disposed on the substrate and comprises a metal spring. The metal spring is electrically coupled to the first conductive portion when the first housing and the second housing are connected to each other.

In accordance with an embodiment of the present disclosure, the first conductive portion, the second conductive portion, the first radiating portion and the second radiating portion are disposed on a first surface of the second housing.

In accordance with an embodiment of the present disclosure, the foregoing multi-band antenna further includes a third conductive portion disposed on the second housing. The third conductive portion is electrically coupled to the first conductive portion and penetrates through the first surface and a second surface of the second housing. When the first housing and the second housing are connected to each other, the feeding portion is electrically coupled to the first conductive portion via the third conductive portion.

In accordance with an embodiment of the present disclosure, the first conductive portion, the second conductive portion, the first radiating and the second radiating are disposed on a second surface of the second housing.

In accordance with an embodiment of the present disclosure, the metal ring is a continuous metal structure.

In summary, through implementing the disclosure of the foregoing multi-band antenna structures, the bandwidth of resonant modes, antenna gain and performance of the portable communication device can be improved, and interference with the antenna caused by outside objects can be reduced. Therefore, high communication quality of the portable communication device is ensured.

BRIEF DESCRIPTION OF THE DRAWINGS

The subject application can be more fully understood by reading the following detailed description of the embodiment, with reference made to the accompanying drawings as follows.

DETAILED DESCRIPTION

Figure 1:
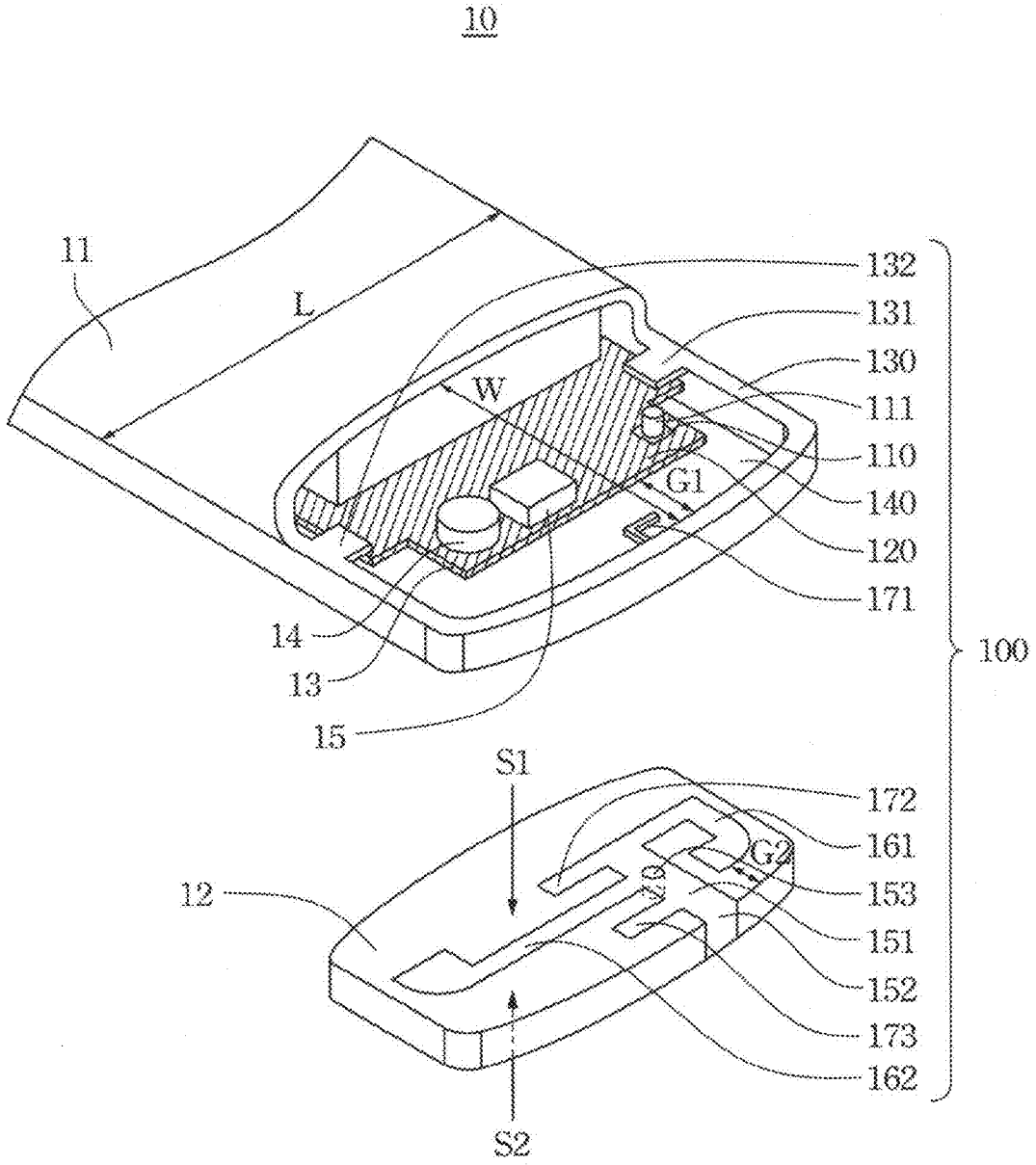
FIG. 1 is a perspective view of a portable communication device according to a first embodiment of the present invention.

In the following detailed description, for purposes of explanation, numerous specific details are set forth in order to attain a thorough understanding of the disclosed embodiments. It will be apparent, however, that one or more embodiments may be practiced without these specific details. In other instances, well-known structures and devices are schematically shown in order to simplify the drawing.

FIG. 1 is a perspective view of a portable communication device 10 according to a first embodiment of the present invention. The portable communication device 10 can include at least a multi-band antenna 100, a first housing 11, a second housing 12, a substrate 13, a processor, a touch module, a display module, an input module, a power module and related electronic circuits (not shown). The multi-band antenna 100 can include a feeding portion 110, a system ground plane 120, a metal ring 130, a resonant cavity 140, a first radiating portion 161 and a second radiating portion 162. The radiating portions 161 and 162 are used to generate resonant frequencies of a plurality of frequency bands. Furthermore, an exterior (appearance) of the portable communication device 10 can at least include the first housing 11, the second housing 12, the metal ring 130, a bezel and/or an outer frame (not shown), etc, in which the metal ring 130 can be constructed as a portion of the housings 11, 12 or a portion of the bezel and/or the outer frame.

In an embodiment of the present invention, the system ground plane 120 is disposed on the substrate 13, the metal ring 130 is connected to the first housing 11 and cooperatively construct as a portion of the exterior (appearance), and the metal ring 130 and the first housing 11 cooperatively form a space to accommodate the substrate 13, related electronic components (such as an electronic component 14 and an electronic component 15) and related electronic circuits. In this manner, the metal ring 130 acts as a segment of the bezel and/or an outer frame, and can also be regarded as a portion of the exterior (appearance). Moreover, the metal ring 130 can be electrically coupled to the system ground plane 120 via a ground end 131 and a ground end 132.

The resonant cavity 140 is formed between the system ground plane 120 and the metal ring 130 to construct a slot antenna with the metal ring 130 and generate a first resonant mode (or a first high-frequency mode), for example, an operating frequency band(s) of DCS-1800 and/or PCS-1900.

In this embodiment, a transverse dimension L of the metal ring 130, a longitudinal dimension W of the metal ring 130 and a first gap width G1 of the resonant cavity 140 are used to control at least one of a resonant frequency of the first resonant mode, a bandwidth of the first resonant mode and a return loss of the first resonant mode. In practice, the transverse dimension L of the metal ring 130 can be 65 mm, the longitudinal dimension W of the metal ring 130 can be 16 mm and the first gap width G1 of the resonant cavity 140 can be 6 mm, in order to precisely control the resonant frequency (also known as the central operating frequency) of the first resonant mode within the operating frequency bands of DCS-1800 and PCS-1900, namely, between 1710 MHz and 1990 MHz.

In an embodiment of present invention, the multi-band antenna 100 further includes a first metal element 171. The first metal element 171 is disposed inside the resonant cavity 140, and may be electrically coupled to the system ground plane 120 via the metal ring 130. The electrical length of the first metal element 171 is used to adjust a length of a current path for controlling the resonant frequency of the first resonant mode. For example, when the electrical length of the first metal element 171 is increased, the current path is lengthened, and accordingly the central operating frequency of the first resonant mode is decreased.

The first radiating portion 161 can be disposed on the second housing 12. When the first housing 11 and the second housing 12 are connected to each other, the first radiating portion 161 can be electrically coupled to the feeding portion 110 for generating a second resonant mode. Similarly, the second radiating portion 162 can be disposed on the second housing 12. When the first housing 11 and the second housing 12 are connected to each other, the second radiating portion 162 can be electrically coupled to the feeding portion 110, for generating a third resonant mode.

In an embodiment of present invention, the multi-band antenna 100 further includes a first conductive portion 151 and a second conductive portion 152. The first conductive portion 151 can be disposed on the second housing 12. The first radiating portion 161 is electrically coupled to one side of the first conductive portion 151, and the second radiating portion 162 is electrically coupled to another side of the first conductive portion 151. When the first housing 11 and the second housing 12 are connected to each other, the first conductive portion 151 can be electrically coupled to the feeding portion 110. The second conductive portion 152 can be disposed on the second housing 12 and electrically coupled to the first conductive portion 151. When the first housing 11 and the second housing 12 are connected to each other, the second conductive portion 152 can be electrically coupled to the metal ring 130.

In this embodiment, when the first housing 11 and the second housing 12 are connected to each other, a projection of the first conductive portion 151 with respect to the normalized view of the substrate 13 at least partially overlaps the resonant cavity 140. In practice, the first conductive portion 151 and the resonant cavity 140 would not directly be connected with each other. It is partially with projection overlap from the view of the normalized plane.

In an embodiment of the presented invention, when the electrical length (or resonant path) of the second radiating portion 162 is longer than the electrical length of the first radiating portion 161, the resonant frequency (also known as the central operating frequency) of the third resonant mode (or the first low frequency mode, e.g., GSM-900) is smaller than the resonant frequency of the second resonant mode (or the second high frequency mode, e.g., UMTS-2100). On the other hand, when the electrical length of the second radiating portion 162 is shorter than the electrical length of the first radiating portion 161, the resonant frequency of the third resonant mode is larger than the resonant frequency of the second resonant mode.

In an embodiment of the present invention, the multi-band antenna 100 further includes a second metal element 172 and a third metal element 173. Both of the metal elements 172, 173 are disposed on the second housing 12 and electrically coupled to the first conductive portion 151, in which the electrical length of the second metal element 172 is used to adjust an impedance matching of the first radiating portion 161, and the electrical length of the third metal element 173 is used to adjust an impedance matching of the second radiating portion 162. Therefore, by adjusting the electrical length of the second metal element 172, at least one of the resonant frequency, the bandwidth and return loss of the second resonant mode can be controlled. Similarly, by adjusting the electrical length of the third metal element 173, at least one of the resonant frequency, the bandwidth and return loss of the third resonant mode can be controlled. It is noted that the second metal element 172 and the third metal element 173 are not the essential elements of this embodiment, and a person skilled in the art can dispose related matching circuits on the substrate 13 to realize impedance matching, and this embodiment is not intended to limit the present invention.

In an embodiment of the present invention, the feeding portion 110 can be disposed on the substrate 13 and have a metal spring (or a pogo pin) 111. When the first housing 11 and the second housing 12 are connected to each other, the metal spring 111 can be electrically coupled to the first conductive portion 151 for feeding an interior radio frequency (RF) signal, processed from an RF circuit (not shown) on the substrate 13, to the feeding portion 110, and then transmitting the signal to (a) the first radiating portion 161 and/or the second radiation portion 162, and (b) the first conductive portion 151, the second conductive portion 152 and the metal ring 130. Similarly, an external RF signal can also be fed to the RF circuit and related electrical components on the substrate 13 via the same path, and an explanation of the operation in this regard will not be repeated herein.

In an embodiment of the present invention, the first conductive portion 151, the second conductive portion 152, the first radiation portion 161 and the second radiation portion 162 are disposed on a first surface S1 of the second housing 12. In addition, the multi-band antenna further includes a third conductive portion 153 disposed on the second housing 12. The third conductive portion 153 is electrically coupled to the first conductive portion 151 and penetrates through the first surface S1 and a second surface S2 of the second housing 12. When the first housing 11 and the second housing 12 are connected to each other, the feeding portion 110 is electrically coupled to the first conductive portion 151 via the third conductive portion 153.

In an embodiment of the present invention, the metal ring 130 is a continuous metal structure. The structure of the bezel and/or outer frame of the portable communication device 10 is complete when the metal ring 130 is connected with the first housing 11, so that the performance of the multi-band antenna is minimally interfered with by external objects. In addition, the first housing 11 can be constructed using metal or non-metal. In this embodiment, the electronic element 14 (e.g., a vibrator) and the electronic element 15 (e.g., a microphone) and related electronic circuits can be disposed on the substrate 13 without arranging slot(s), to utilize the space of the portable communication device 10 efficiently.

It is noted that when the first housing 11 and the second housing 12 are connected to each other, the feeding portion 110, the first conductive portion 151, the second conductive portion 152, the third conductive portion 153, the first radiating portion 161, the second radiating portion 162, the second metal element 172 and the third metal element 173 can form an overall structure of a PIFA. The PIFA can connect to the ground end 131 and the ground end 132 via the second conductive portion 152, in which both the ground ends 131, 132 are disposed on the metal ring 130. All the parts of the PIFA can be formed using typical iron elements, copper foil, laser direct structuring (LDS) or by coating conducting liquid and/or paint, and perforation techniques may additionally be used. Furthermore, there is a second gap width G2 between the first radiating portion 161 and an edge of the second housing 12, and the second gap width G2 can be adjusted to control at least one of the resonant frequency of the second resonant mode, the bandwidth of the second resonant mode and the return loss of the second resonant.

Figure 4:
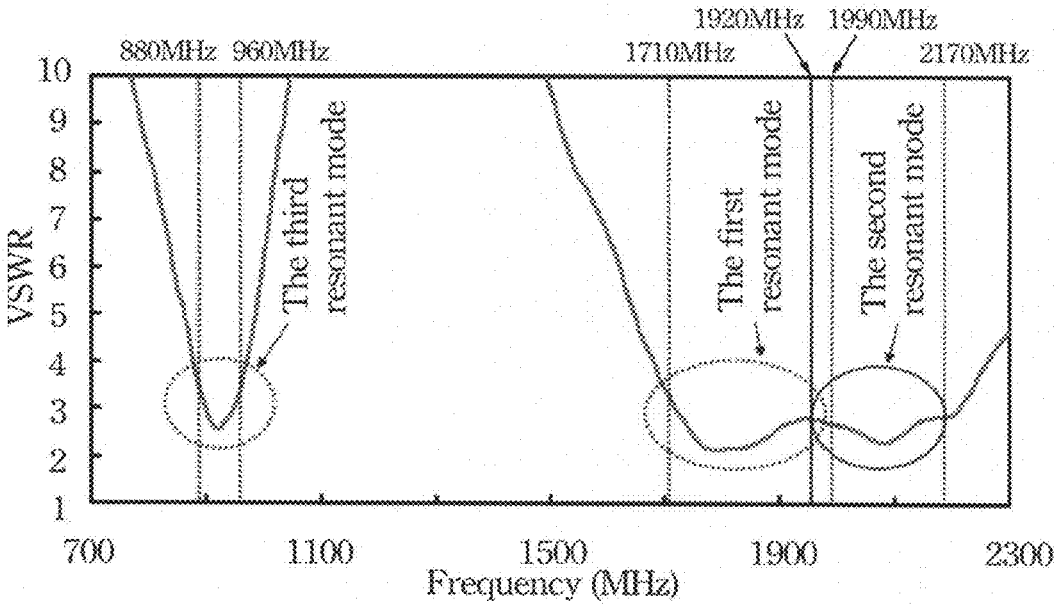
FIG. 4 is a graph of a frequency response of a multi-band antenna for a portable communication device according to an embodiment of the present invention.

FIG. 4 is a graph of a frequency response of a multi-band antenna 100 for a portable communication device 10 according to an embodiment of the present invention. In the foregoing embodiments, the frequency response characteristic of the multi-band antenna 100 can be represented as the correlation between frequency and voltage standing wave ratio (VSWR), as shown in FIG. 4. The VSWR of the multi-band antenna 100 is relatively small (i.e., VSWR<3) in the first resonant mode (1710 MHz~1990 MHz), the second resonant mode (1920 MHz~2170 MHz) and the third resonant mode (824 MHz~960 MHz), such that the portable communication device 10 can operate under the operating frequency bands of DCS-1800 and/or PCS-1900, UMTS-2100 and GSM corresponding to these three resonant modes.

Figure 5:
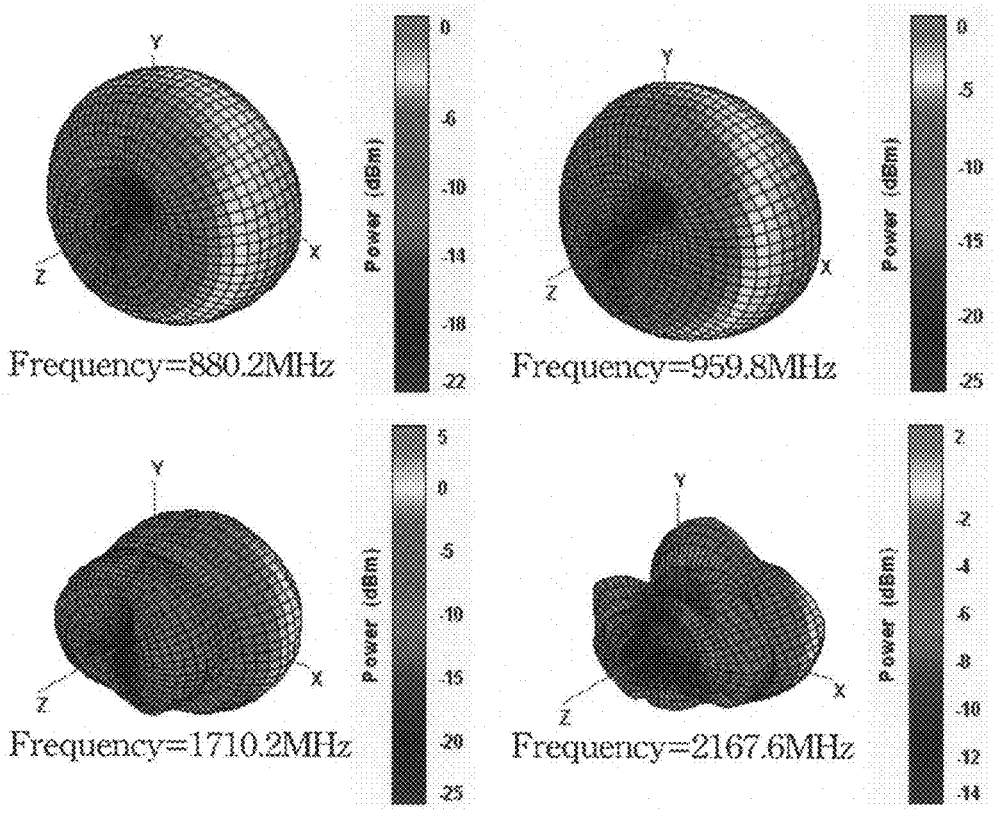
FIG. 5 shows three-dimensional radiation patterns of a multi-band antenna for portable communication device according to an embodiment of the present invention.

FIG. 5 shows three-dimensional radiation patterns of a multi-band antenna 100 for a portable communication device 10 according to an embodiment of the present invention. In the foregoing embodiment, antenna gain and radiation efficiency of the multi-band antenna 100 can be represented as a three-dimensional radiation pattern and antenna performance information corresponding to the pattern, as shown in FIG. 5 and Table. 1.

TABLE 1

| Frequency (MHz) | Efficiency (dB) | Efficiency (%) |
|---|---|---|
| 880.2 | −4.1 | 39.1 |
| 881.6 | −4.1 | 39.1 |
| 893.8 | −3.4 | 45.8 |
| 897.6 | −3.2 | 47.4 |
| 914.8 | −2.7 | 53.6 |
| 925.2 | −2.9 | 51.6 |
| 942.6 | −3.5 | 44.9 |
| 959.8 | −4.4 | 36.6 |
| 1710.2 | −2.7 | 53.5 |
| 1747.8 | −2.8 | 52.5 |
| 1784.8 | −2.4 | 57.1 |
| 1805.2 | −2.1 | 61.8 |
| 1842.6 | −2.0 | 63.6 |
| 1850.2 | −2.0 | 62.7 |
| 1879.8 | −2.1 | 62.2 |
| 1880 | −2.1 | 62.2 |
| 1909.8 | −2.2 | 60.5 |
| 1922.4 | −2.1 | 61.3 |
| 1930.2 | −2.0 | 62.8 |
| 1950 | −1.9 | 64.9 |
| 1960 | −1.9 | 64.1 |
| 1977.8 | −2.1 | 61.3 |
| 1989.8 | −2.3 | 58.3 |
| 2112.4 | −3.4 | 45.3 |
| 2140 | −3.5 | 44.4 |
| 2167.6 | −3.3 | 47.1 |

For example, within the frequency band of the first resonant mode DCS-1800/PCS-1900 and the second resonant mode UMTS-2100, namely 1710 MHz~2170 MHz, the radiation efficiency of the first multi-band antenna 100 is larger than 44%. On the other hand, within the frequency band of the third resonant mode GSM-900, namely 880 MHz~960 MHz, the radiation efficiency of the first multi-band antenna 100 is larger than 36%.

Figure 2:
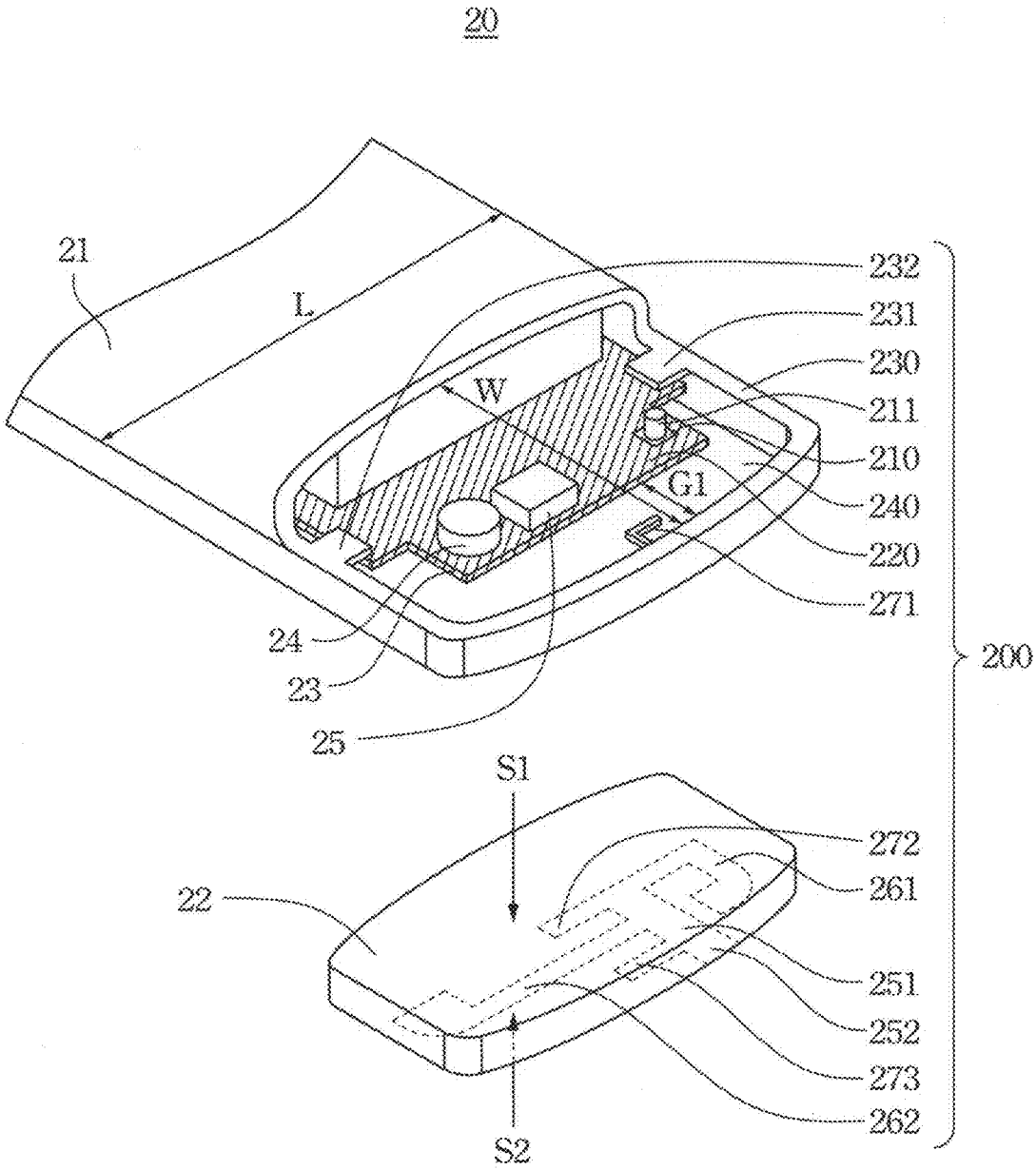
FIG. 2 is a perspective view of a portable communication device according to a second embodiment of the present invention.

FIG. 2 is a perspective view of a portable communication device 20 according to a second embodiment of the present invention. The portable communication device 20 at least includes a multi-band antenna 200, a first housing 21, a second housing 22, substrate 23 and related modules and electronic circuit elements (not shown). As in the case of the above embodiment, the multi-band antenna 200 can include a feeding portion 210, a system ground plane 220, a metal ring 230, a resonant cavity 240, a first conductive portion 251, a second conductive portion 252, a first radiating portion 261 and a second radiating portion 262. The structure and operation of the multi-band antenna 200 are similar to or the same as those of the multi-band antenna 100 of the portable communication device 10 described with reference to FIG. 1, and therefore, a description in this regard will not be repeated herein.

In an embodiment of the present invention, the first conductive portion 251, the second conductive portion 252, the first radiating portion 261 and the second radiating portion 262 are disposed on the second surface S2 of the second housing 22. Therefore, when the first housing 21 and the second housing 22 are connected to each other, the feeding portion 210 can be directly electrically coupled to the first conductive portion 251 for feeding RF signals, without having to go through the third conductive portion 153 as shown in FIG. 1.

Figure 3A:
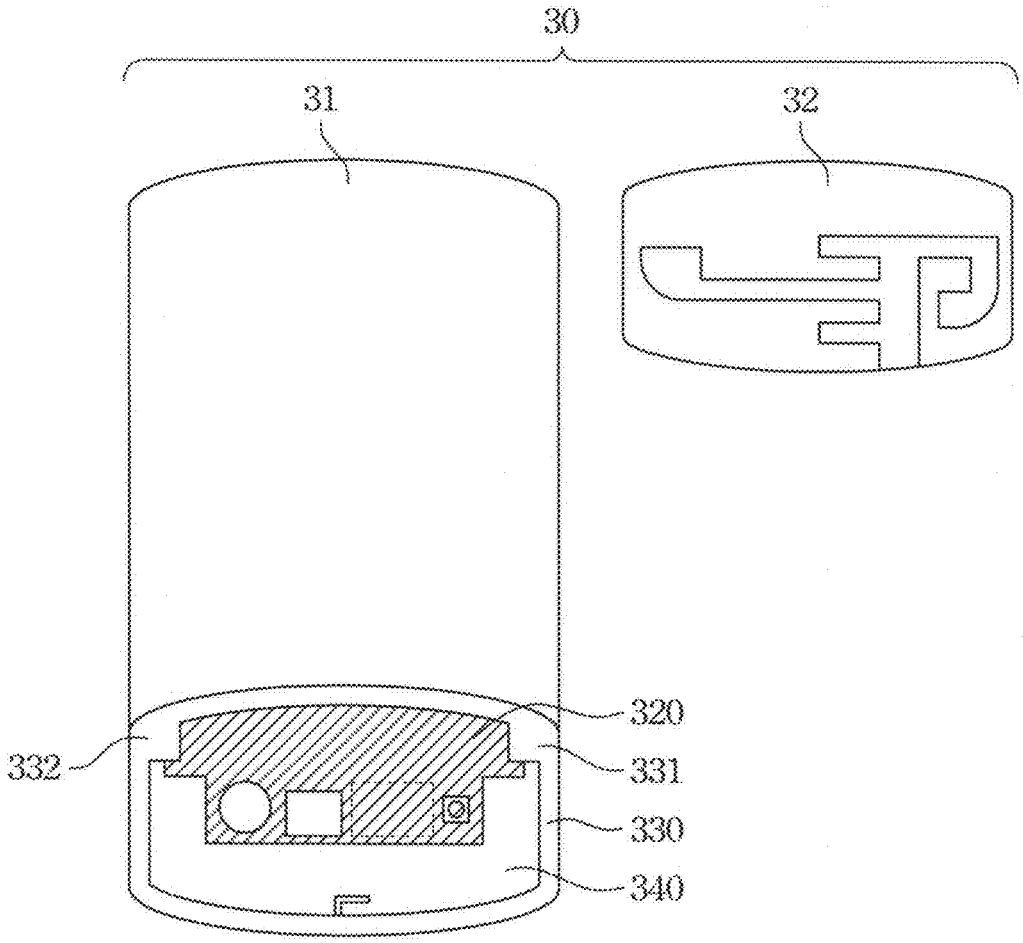
FIG. 3A is a plan view of a portable communication device according to an embodiment of the present invention.
Figure 3B:
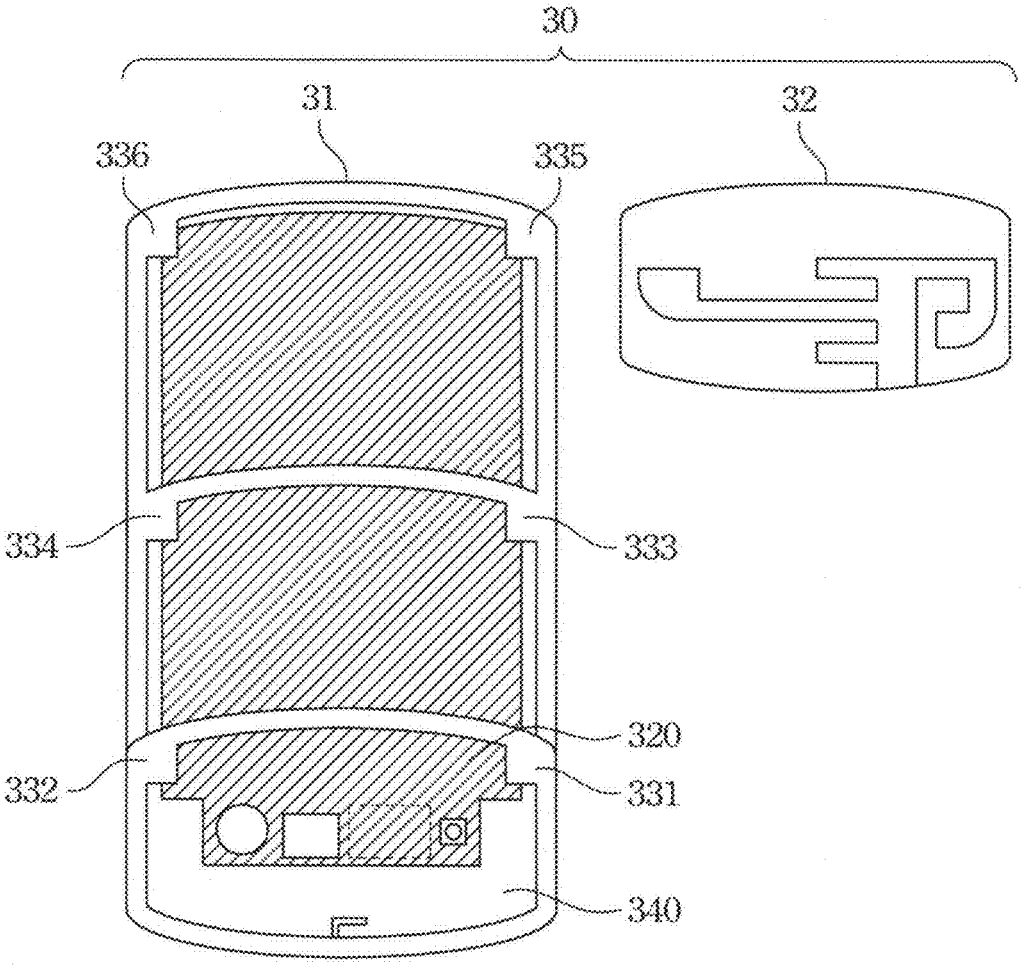
FIG. 3B is another plan view of the portable communication device shown in FIG. 3A.

FIG. 3A and FIG. 3B are plan views of a portable communication device 30 according to an embodiment of the present invention. The portable communication device 30 includes a multi-band antenna, a first housing 31, a second housing 32 and a substrate 33. In this embodiment, the structure and operation of the multi-band antenna are similar to or the same as those of the foregoing embodiment, and so a description in this regard will not be repeated herein. When the first housing 31 is a non-metal frame structure, there is an arc shaped metal connection between a ground end 331 and a ground end 332 so that a metal ring 330 and a resonant cavity 340 can form a slot antenna, as shown in FIG. 3A. It is noted that when the first housing 31 is a metal frame structure, the metal ring 330 can be electrically coupled to a system ground plane 320 not only via the ground end 331 and the ground end 332, but also via other ground ends (namely, ground ends 333~336), as shown in FIG. 3B, and the subject application is not limited to this structure, deployment and connection type.

In summary, through implementing the features of the subject application, a multi-band antenna with slot antenna(s) and PIFA(s) can be constructed and the space inside the portable communication device can be increased. Moreover, the interference caused by external objects can be reduced by deploying a continuous metal ring. Therefore, the bandwidth, the antenna gain, and the antenna radiation efficiency of the portable communication device can be improved, and the communication quality of the portable communication device is ensured.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A multi-band antenna for a portable communication device, the portable communication device comprising a first housing, a second housing and a substrate, and the multi-band antenna comprising:

a feeding portion;

a system ground plane disposed on the substrate;

a metal ring directly connected to the first housing, the metal ring and the first housing cooperatively forming a space to accommodate the substrate, wherein the metal ring is electrically coupled to the system ground plane through a plurality of ground ends;

a resonant cavity formed between the system ground plane and the metal ring, and to generate a first resonant mode with the metal ring;

a first radiating portion disposed on the second housing, the first radiating portion being operatively and electrically coupled to the feeding portion, wherein the first radiating portion is electrically coupled to the feeding portion for generating a first resonant mode when the first housing and the second housing are connected to each other, and the first radiating portion is isolated from the feeding portion and does not generate the first resonant mode when the first housing and the second housing are separated from each other; and a second radiating portion disposed on the second housing, the second radiating portion being operatively and electrically coupled to the feeding portion, wherein the second radiating portion is electrically coupled to the feeding portion for generating a second resonant mode when the first housing and the second housing are connected to each other, and the second radiating portion is isolated from the feeding portion and does not generate the second resonant mode when the first housing and the second housing are separated from each other;

wherein the first housing comprises an opening, and the second housing is configured to be operatively attached to the opening of the first housing to cooperatively form an exterior housing of the portable communication device.

2. The multi-band antenna of claim 1, further comprising:

a first conductive portion disposed on the second housing, wherein the first radiating portion is electrically coupled to one side of the first conductive portion, the second radiating portion is electrically coupled to anther side of the first conductive portion, and the first conductive portion is electrically coupled to the feeding portion when the first housing and the second housing are connected to each other; and a second conductive portion disposed on the second housing and electrically coupled to the first conductive portion, wherein the second conductive portion is electrically coupled to the metal ring when the first housing and the second housing are connected to each other;

wherein, when the first housing and the second housing are connected to each other, a projection of the first conductive portion with respect to a normalized view of the substrate at least partially overlaps the resonant cavity.

3. The multi-band antenna of claim 1, wherein a transverse dimension of the metal ring, a longitudinal dimension of the metal ring and a first gap width of the resonant cavity are used to control at least one of a resonant frequency of the first resonant mode, a bandwidth of the first resonant mode and a return loss of the first resonant mode.

4. The multi-band antenna of claim 1, further comprising: a first metal element disposed in the resonant cavity, an electrical length of the first metal element adjusting a current path and controlling a resonant frequency of the first resonant mode.

5. The multi-band antenna of claim 1, wherein when an electrical length of the second radiating portion is longer than an electrical length of the first radiating portion, a resonant frequency of the third resonant mode is smaller than a resonant frequency of the second resonant mode.

6. The multi-band antenna of claim 1, wherein when an electrical length of the second radiating portion is shorter than an electrical length of the first radiating portion, a resonant frequency of the third resonant mode is larger than a resonant frequency of the second resonant mode.

7. The multi-band antenna of claim 2, further comprising a second metal element and a third metal element, both disposed on the second housing and electrically coupled to the first conductive portion, wherein an electrical length of the second metal element is used to adjust an impedance matching of the first radiating portion, and an electrical length of the third metal element is used to adjust an impedance matching of the second radiating portion.

8. The multi-band antenna of claim 2, wherein the feeding portion is disposed on the substrate, the feeding portion comprises a metal spring, and the metal spring is electrically coupled to the first conductive portion when the first housing and the second housing are connected to each other.

9. The multi-band antenna of claim 2, wherein the first conductive portion, the second conductive portion, the first radiating portion and the second radiating portion are disposed on a first surface of the second housing.

10. The multi-band antenna of claim 9, further comprising a third conductive portion disposed on the second housing, the third conductive portion being electrically coupled to the first conductive portion and penetrating through the first surface and a second surface of the second housing, wherein when the first housing and the second housing are connected to each other, the feeding portion is electrically coupled to the first conductive portion via the third conductive portion.

11. The multi-band antenna of claim 2, wherein the first conductive portion, the second conductive portion, the first radiating and the second radiating portions are disposed on a second surface of the second housing.

12. The multi-band antenna of claim 1, wherein the metal ring is a continuous metal structure.

* * * * *